US009963645B2

(12) United States Patent
Blue et al.

(10) Patent No.: US 9,963,645 B2
(45) Date of Patent: May 8, 2018

(54) MODULAR BITUMEN PROCESSING SYSTEM AND RELATED METHODS

(71) Applicant: Harris Corporation, Melbourne, FL (US)

(72) Inventors: Mark E. Blue, Palm Bay, FL (US); George S. Wise, IV, Melbourne, FL (US); Martin J. Sandell, Calgary (CA)

(73) Assignee: HARRIS CORPORATION, Melbourne, FL (US)

( * ) Notice: Subject to any disclaimer, the term of this patent is extended or adjusted under 35 U.S.C. 154(b) by 34 days.

(21) Appl. No.: 14/974,511

(22) Filed: Dec. 18, 2015

(65) Prior Publication Data

US 2017/0175010 A1 Jun. 22, 2017

(51) Int. Cl.
*C10G 33/00* (2006.01)

(52) U.S. Cl.
CPC ..... *C10G 33/00* (2013.01)

(58) Field of Classification Search
CPC ..... B01J 2219/0002; C10G 33/00
See application file for complete search history.

(56) References Cited

U.S. PATENT DOCUMENTS

| | | | | |
|---|---|---|---|---|
| 3,126,961 | A * | 3/1964 | Craig et al. | E21B 43/2406 166/303 |
| 3,881,550 | A * | 5/1975 | Barry | E21B 43/24 166/266 |
| 4,362,213 | A * | 12/1982 | Tabor | E21B 43/168 166/267 |
| 6,883,607 | B2 | 4/2005 | Nenniger et al. | |
| 8,616,273 | B2 * | 12/2013 | Trautman | E21B 43/16 166/248 |
| 8,776,877 | B2 | 7/2014 | Trautman et al. | |
| 8,951,392 | B2 | 2/2015 | James | |
| 2010/0122641 | A1 | 5/2010 | Molaro et al. | |
| 2011/0089013 | A1 * | 4/2011 | Sakurai et al. | B01D 17/0205 201/2 |
| 2012/0193093 | A1 | 8/2012 | James | |
| 2014/0193761 | A1 | 7/2014 | Donnelly et al. | |
| 2014/0202686 | A1 | 7/2014 | Trautman et al. | |
| 2014/0318630 | A1 | 10/2014 | Gieskes | |
| 2015/0122631 | A1 | 5/2015 | James et al. | |
| 2015/0203363 | A1 | 7/2015 | James et al. | |

FOREIGN PATENT DOCUMENTS

| | | | |
|---|---|---|---|
| CA | 2747886 | 1/2013 | |
| CA | 2777966 | 11/2013 | |
| CA | 2777966 A1 * | 11/2013 | E21B 43/34 |

OTHER PUBLICATIONS

A. Bera and T. Babadagli, Status of Electromagnetic Heating for Enhanced Heavy Oil/Bitumen Recovery and Future Prospects: A Review, 151 Appl. Energy 206-226 (2015).*

1 Site Single Pad Facility: http://www.oakpointenergy.ca/teohnology/1nsitesagd: retrieved from internet 0/26/2015; pp. 2.

Grizzly May River SAGD Project; Section 4: Dec. 2013: Grizzly Oil Sands ULC, pp. 42.

* cited by examiner

*Primary Examiner* — Randy Boyer
(74) *Attorney, Agent, or Firm* — Allen, Dyer, Doppelt + Gilchrist, P.A.

(57) ABSTRACT

A portable modular treatment system to be remotely deployed adjacent a solvent extraction bitumen well may include a portable initial separation module configured to receive a liquid emulsion from the solvent extraction bitumen well including bitumen, produced water, solvent, and at least one non-condensable gas, and liberate the at least one non-condensable gas while the solvent remains with the liquid emulsion. The system may further include a portable free water removal module configured to receive the liquid emulsion from the portable initial separation module and separate the bitumen and solvent from the produced water, a portable skimming tank module configured to receive the produced water from the portable free water removal module and remove free oil from the produced water through gravity separation, and a portable condenser module configured to receive the bitumen and solvent from the portable free water removal module and separate the bitumen and solvent.

24 Claims, 4 Drawing Sheets

MODULAR BITUMEN PROCESSING SYSTEM AND RELATED METHODS

TECHNICAL FIELD

The present invention relates to hydrocarbon resource recovery systems, and more particularly, to systems and methods for processing recovered bitumen mixtures from solvent extraction bitumen wells.

BACKGROUND

Energy consumption worldwide is generally increasing, and conventional hydrocarbon resources are being consumed. In an attempt to meet demand, the exploitation of unconventional resources may be desired. For example, highly viscous hydrocarbon resources, such as heavy oils, may be trapped in oil sands where their viscous nature does not permit conventional oil well production. Estimates are that trillions of barrels of oil reserves may be found in such oil sand formations.

In some instances these oil sand deposits are currently extracted via open-pit mining. Another approach for in situ extraction for deeper deposits is known as Steam-Assisted Gravity Drainage (SAGD). The heavy oil is immobile at reservoir temperatures and therefore the oil is typically heated to reduce its viscosity and mobilize the oil flow. In SAGD, pairs of injector and producer wells are formed to be laterally extending in the ground. Each pair of injector/producer wells includes a lower producer well and an upper injector well. The injector/producer wells are typically located in the payzone of the subterranean formation between an underburden layer and an overburden layer.

The upper injector well is used to typically inject steam, and the lower producer well collects the heated crude oil or bitumen that flows out of the formation, along with any water from the condensation of injected steam. The injected steam forms a steam chamber that expands vertically and horizontally in the formation. The heat from the steam reduces the viscosity of the heavy crude oil or bitumen which allows it to flow down into the lower producer well where it is collected and recovered. The steam and gases rise due to their lower density so that steam is not produced at the lower producer well and steam trap control is used to the same effect. Gases, such as methane, carbon dioxide, and hydrogen sulfide, for example, may tend to rise in the steam chamber and fill the void space left by the oil defining an insulating layer above the steam. Oil and water flow is by gravity driven drainage, into the lower producer well.

Various approaches are used to process the emulsion from SAGD wells. One such approach is set forth in U.S. Pat. No. 8,951,392 to James, which is directed to a modular portable evaporator system for use in SAGD systems having an evaporator, with a sump including an oil skimming weir, a short tube vertical falling film heat exchanger including an outer shell containing short tubes provided for lower water circulation rate. The system further has, external to the evaporator, a compressor for compressing evaporated steam from the tube side of the heat exchanger and routing to the shell side of the same exchanger, a distillate tank to collect hot distilled water, a recirculation pump to introduce liquids from the sump into the heat exchanger, and an external suction drum protecting the compressor from liquid impurities. The evaporator system receives produced water from the SAGD process into the sump and provides cleaned hot water to a boiler.

One consequence of the SAGD process is that it adds a significant amount of water to the emulsion output from the well, as several barrels of water (as steam) are typically injected into the well to recover one barrel of bitumen. As a result, a relatively expensive inlet diluent (e.g., naphtha) may be required, as emulsified bitumen and water have nearly the same gravity which necessitates the addition of diluents to lower the bitumen's gravity for free water knock out.

Furthermore, additional diluent may also be required during later stages of processing. In particular, most SAGD processing facilities export the extracted bitumen to refineries via pipelines. Yet, most bitumen supplies are required to include ~30% diluent by volume to meet applicable pipeline requirements.

Accordingly, further enhancements may be desirable for bitumen extraction and treatment in certain applications.

SUMMARY

A portable modular treatment system is to be remotely deployed adjacent a solvent extraction bitumen well and may include a portable initial separation module configured to receive a liquid emulsion from the solvent extraction bitumen well comprising bitumen, produced water, solvent, and at least one non-condensable gas, and liberate the at least one non-condensable gas while the solvent remains with the liquid emulsion. The system may further include a portable free water removal module configured to receive the liquid emulsion from the portable initial separation module and separate the bitumen and solvent from the produced water, a portable skimming tank module configured to receive the produced water from the portable free water removal module and remove free oil from the produced water through gravity separation, and a portable condenser module configured to receive the bitumen and solvent from the portable free water removal module and separate the bitumen and solvent.

More particularly, the portable initial separation module may be pressurized to a first pressure, and the portable free water removal module may be pressurized to a second pressure less than the first pressure. Moreover, the portable condenser module may be at atmospheric pressure while cooled, and the first and second pressures may be above atmospheric pressure. The portable condenser module may be further configured to receive the at least one non-condensable gas from the portable initial separation module as fuel.

In addition, the portable skimming tank module may include at least one weir oil skimmer. Also, the portable skimming tank module may include at least one cooler for cooling the produced water prior to removal of the free oil through gravity separation. Furthermore, the portable condenser module may comprise a vapor recovery unit.

The solvent and bitumen may be maintained at a temperature of at least 75° C. within the portable initial separation module, portable free water removal module, and portable condenser module. Moreover, the system may further include at least one bitumen holding tank for receiving the separated bitumen from the portable condenser module, and at least one heater for maintaining the bitumen at a temperature of at least 75° C. while in at least one bitumen holding tank for transfer by truck or heated bitumen pipeline to at least one railcar.

Additionally, the portable initial separation module may comprise a plurality thereof connected in parallel to the emulsion from the bitumen well. Furthermore, each of the portable initial separation module, the portable free water removal module, the portable skimming tank, and the portable condenser module may each comprise a respective frame for truck transportation.

A related method is for treating a liquid emulsion comprising bitumen, produced water, solvent, and at least one non-condensable gas locally at a solvent extraction bitumen well. The method may include receiving a liquid emulsion from the solvent extraction bitumen well in a portable initial separation module and liberating the at least one non-condensable gas while the solvent remains with the liquid emulsion. The method may further include receiving the liquid emulsion from the portable initial separation module in a portable free water removal module and separating the bitumen and solvent from the produced water, receiving the produced water from the portable free water removal module in a portable skimming tank module and removing free oil from the produced water through gravity separation, and receiving the bitumen and solvent from the portable free water removal module in a portable condenser module and separating the bitumen and solvent.

DETAILED DESCRIPTION OF THE EMBODIMENTS

Figure 1:
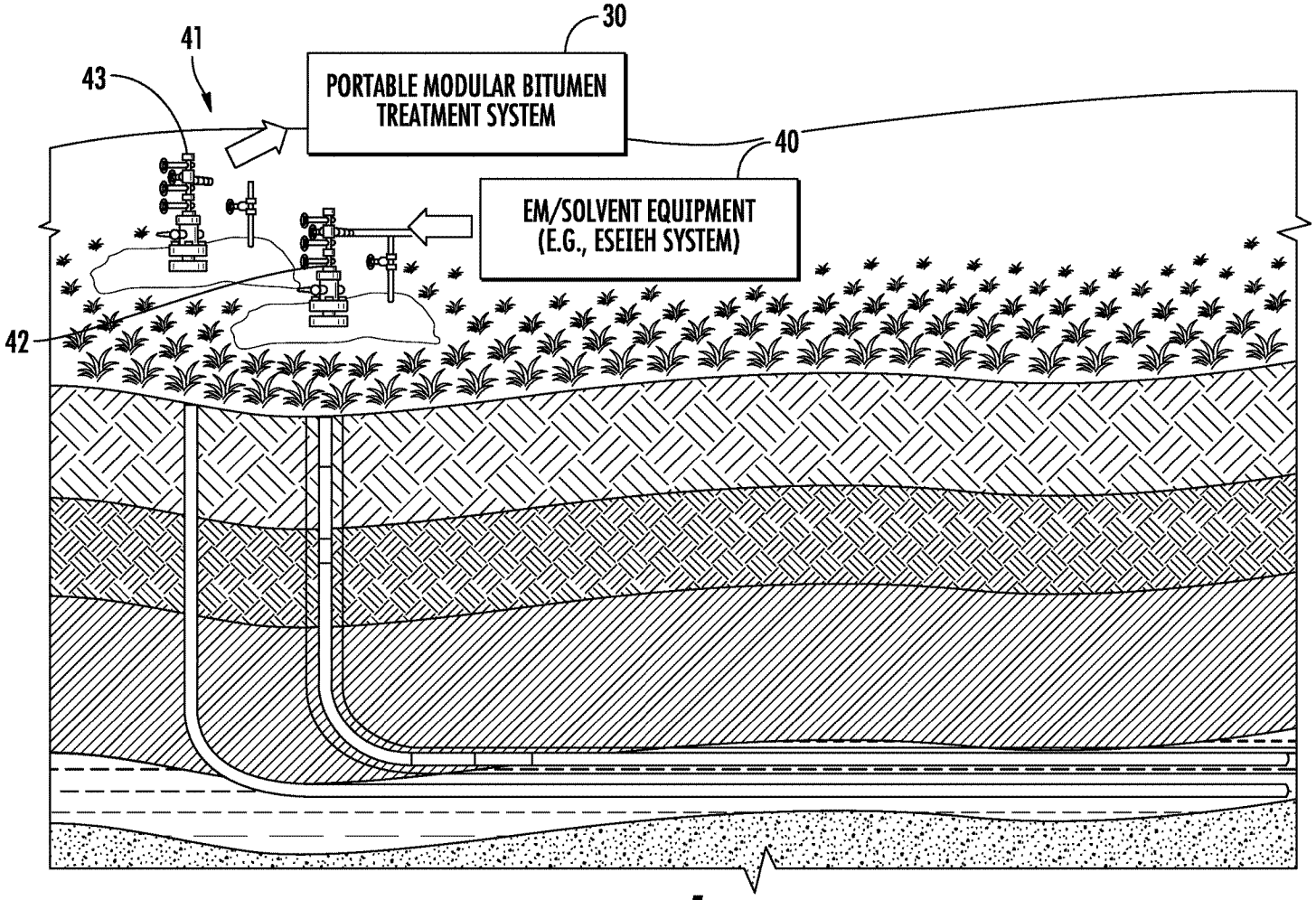
FIG. 1 is a perspective view of a portable modular treatment system remotely located at a bitumen well.
Figure 2:
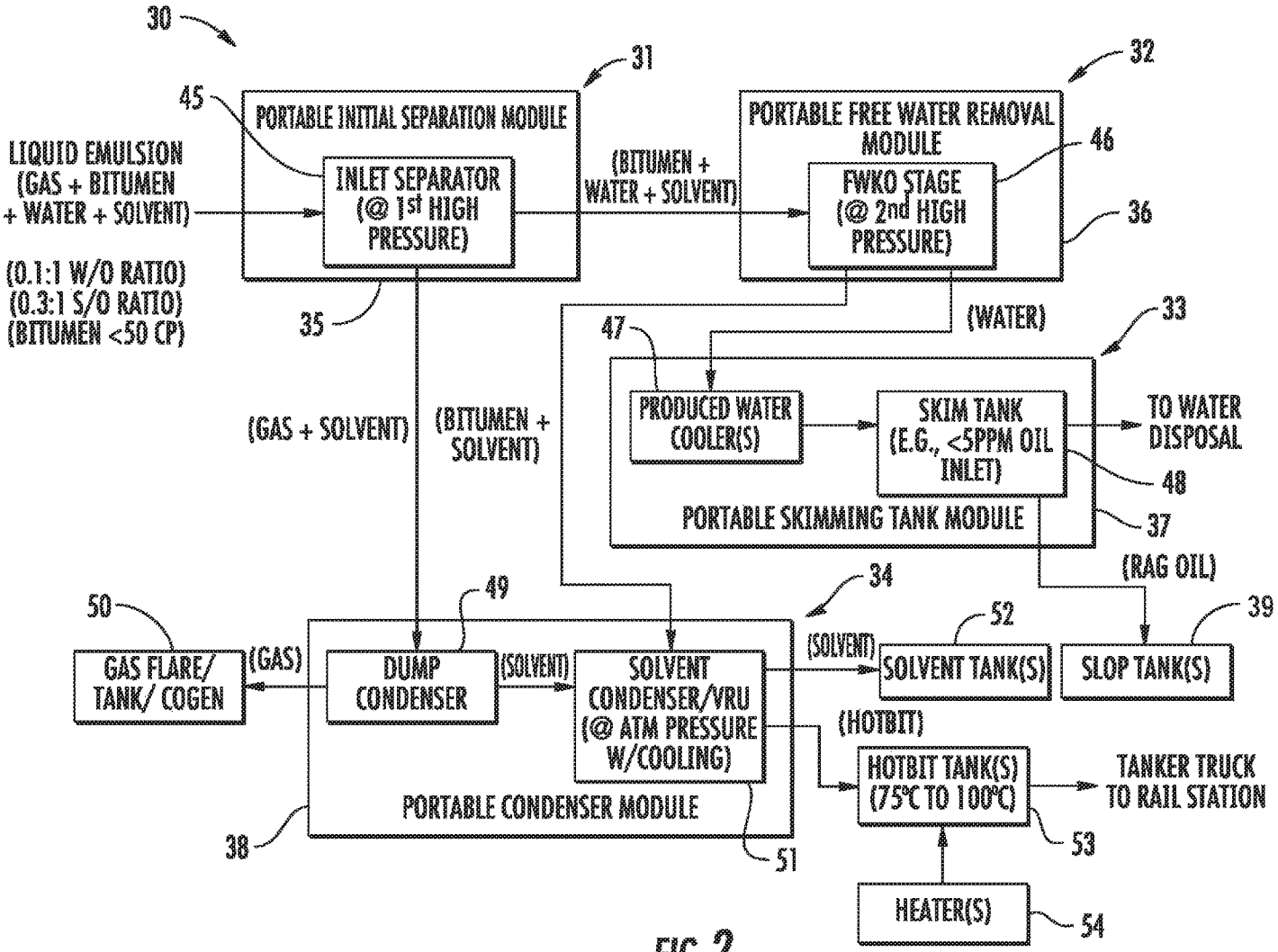
FIG. 2 is a schematic diagram of an example implementation of the portable module treatment system of FIG. 1.

The present invention will now be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Referring now to FIGS. 1 through 4, a hydrocarbon resource recovery system 30 and associated method aspects are first described. In the illustrated example, the system 30 illustratively includes a portable initial separation module 31, a portable free water removal module 32, a portable skimming tank module 33, and a portable condenser module 34, which will be discussed further below. Each of these modules 31-34 may be implemented using respective portable frames 35-38 in which the various components thereof may be mounted for transportation and assembly at a remote bitumen well 41. In the example illustrated in FIG. 1, one or more of the frames 35-38 may be carried in an ISO container, which provides for ease of transport by truck, rail and ship, although ISO containers need not be used in all embodiments.

In the example of FIG. 1, the system 30 is remotely deployed adjacent a solvent extraction bitumen well 41. More particularly, the well 41 illustratively includes an injector well 42 and a producer well 43. The injector well may utilize equipment 40 which distributes electromagnetic (EM) heat and solvents to mobilize heavy hydrocarbons to the producer well 43, which extracts an emulsion including the hydrocarbons (i.e., bitumen) and solvents used in the process. By way of example, U.S. Pat. No. 8,616,273 to Trautman et al. (which is also assigned to the present Assignee and is hereby incorporated herein in its entirety by reference) discloses one such process called Effective Solvent Extraction Incorporating Electromagnetic Heating, or "ESEIEH" (pronounced "easy"). The embodiments described herein will be with reference to the ESEIEH process, but it will be understood that the processing techniques discussed herein may also be used with other solvent well production approaches.

The ESEIEH process generally creates a solvent rich emulsion which includes approximately 10 parts bitumen, 3 parts solvent and 1 part produced water with associated non-condensable gases (usually including methane, carbon dioxide and other light gases). As a result of the ESEIEH process, the system 30 may advantageously avoid the steam generation of typical modular facilities and forego the process of adding diluent or solvents at the surface, as with typical SAGD processing.

Figure 3:
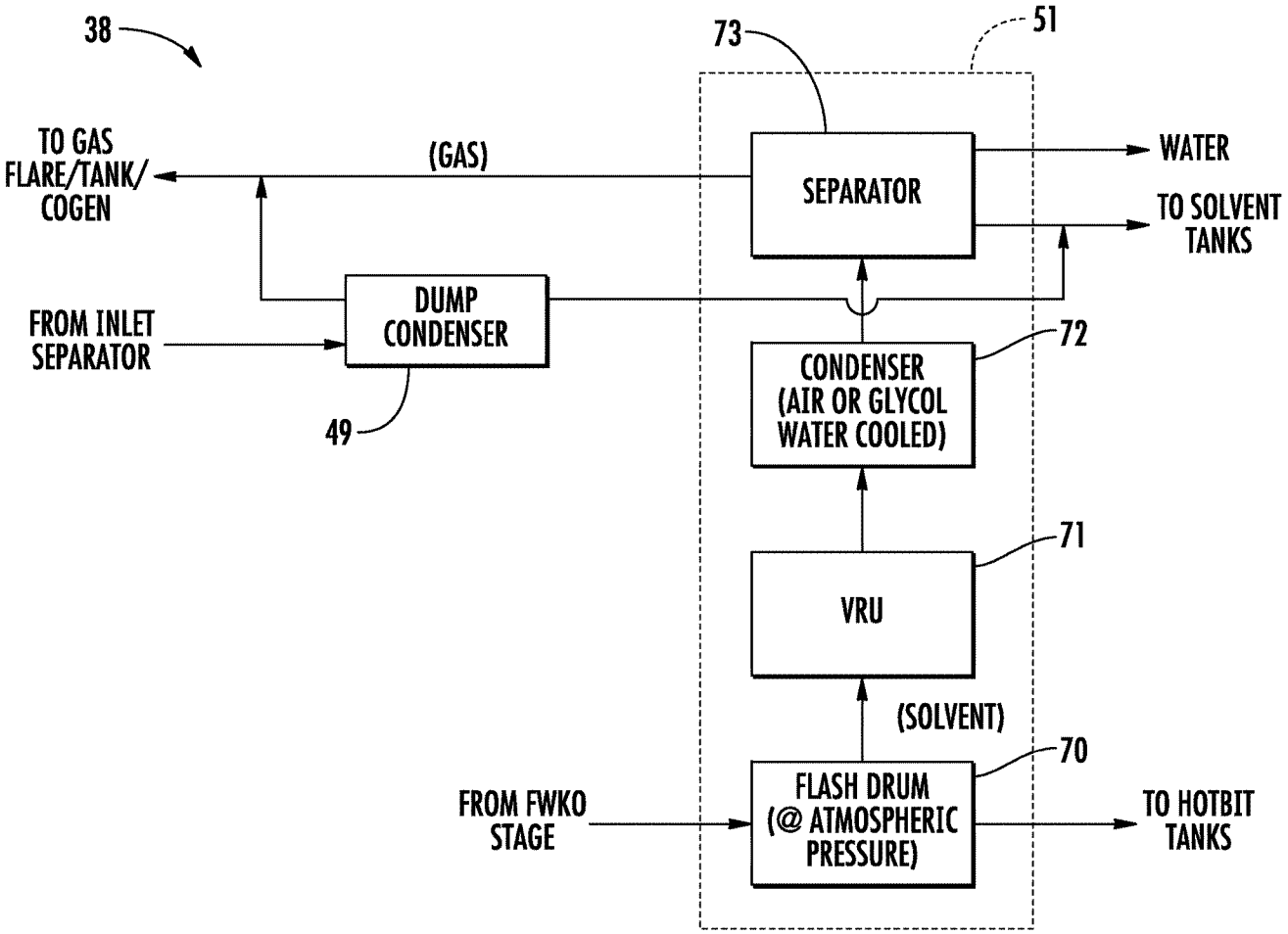
FIG. 3 is a schematic block diagram illustrating an example embodiment of the portable condenser module of the system of FIG. 2 in greater detail.
Figure 4:
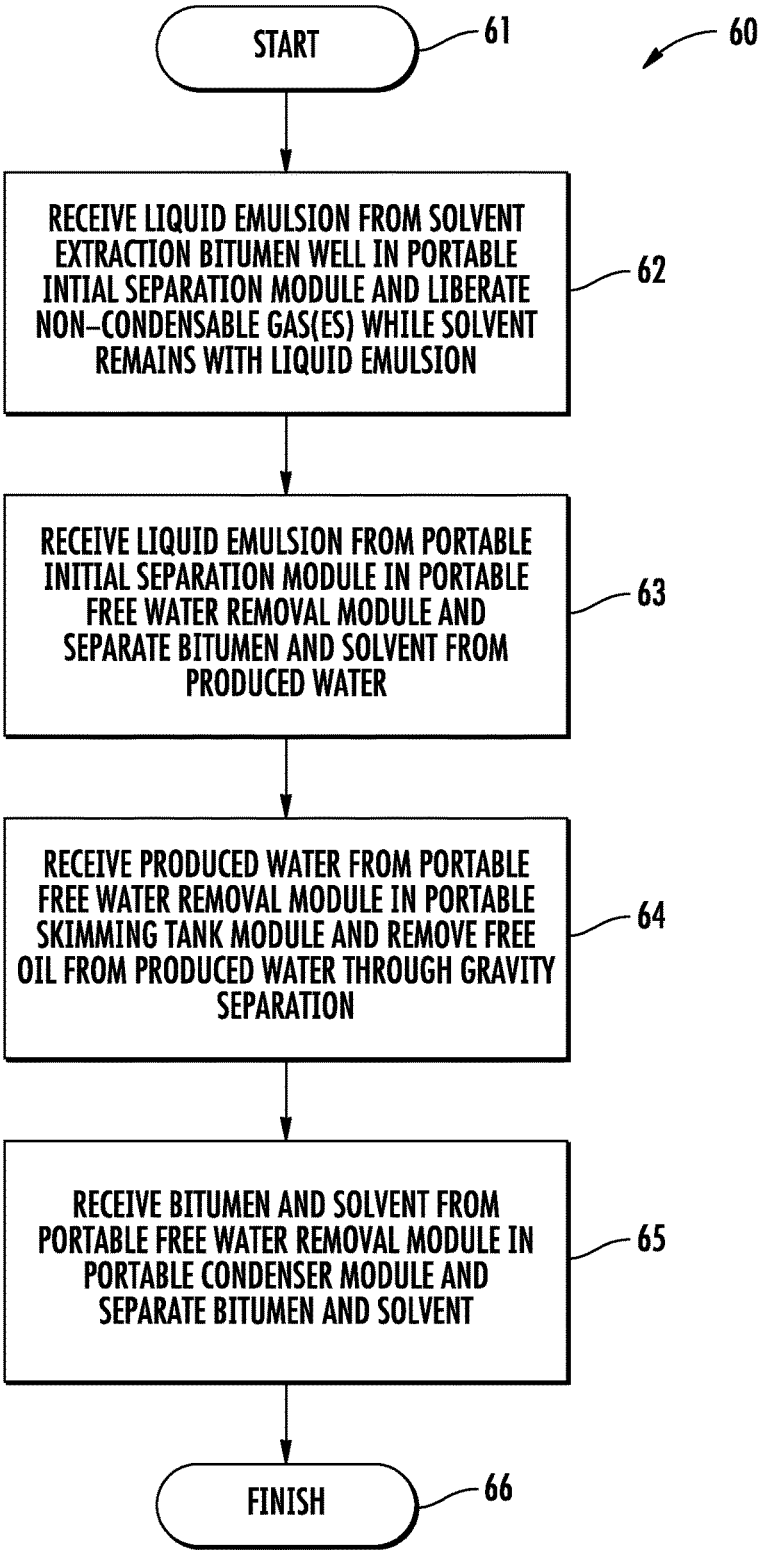
FIG. 4 is a flow diagram illustrating method aspects associated with the system of FIG. 2.

Beginning at Block 61 of the flow diagram 60 in FIG. 3, after the liquid emulsion exits the producer well 43, it is directed to the portable initial separation module 35. The portable initial separation module 35 illustratively includes an inlet separator 45 which operates at such a pressure that the non-condensable gases are liberated from the mixture while the solvent substantially remains within the liquid phase, at Block 62. The gas (containing a portion of the solvent in the vapor phase) is routed to the portable condenser module 34, and the remaining liquids are routed to the portable free water removal module 32.

More particularly, the degassed liquids from the initial separator 45 are routed to the portable free water removal module 32, which includes a Free Water Knock-Out (FWKO) stage 46 that operates at a slightly lower (yet still relatively high) pressure than the inlet separator to ensure the solvent remains within the liquid phase. Produced water (aqueous phase) readily separates from the solvent/bitumen (hydrocarbon phase) due to the lower density of the latter and the low viscosity of both phases, at Block 63.

Produced water is routed from the portable free water removal module 32 to the portable skimming tank module 33 for treatment to remove free oil, at Block 64. The produced water from the portable free water removal module 32 generally has an oil content of less than 5,000 ppm, and is directed to produced water coolers 47, which may exchange heat with a glycol/water mixture or may be forced draft air coolers. The cooled produced water flows to a produced water skim tank 48. By way of example, a weir or similar skimming arrangement within the skim tank 48 removes free oil that separates under gravity from the produced water. The separated oil may optionally be pumped to a slop tank 39, which may be included at a well pad as part of associated field assets for the system 30, for example. The separated produced water may be pumped to a disposal well, for example, where it is injected in to a suitable underground formation.

The hydrocarbon phase (bitumen plus solvent) from the portable free water removal module 32 is routed to the portable condenser module 34 to separate the bitumen and solvent, at Block 65. Separated gas from the inlet separator 45 is routed to a dump condenser 49 (glycol/water exchanger or forced draft air cooler) of the portable condenser module 34 where any solvent is condensed and subsequently separated for re-use. The non-condensable gas stream may be used as fuel for process heating and power generation, or flared by gas flare/tank/cogeneration equipment 50.

Furthermore, separated solvent from the portable free water removal module 32, which is in the vapor phase, and from the dump condenser 49 is compressed by a solvent condenser/Vapor Recovery Unit (VRU) 51 of the portable condenser module 34, and may then be condensed at high pressure before being routed to a solvent accumulator vessel or tank 52. The solvent tank(s) 52 may be part of the aforementioned field assets at the well pad. As the example illustrated in FIG. 3, the solvent condenser/Vapor Recovery Unit (VRU) 51 illustratively includes a flash drum 70 (operating at atmospheric pressure) which receives the output from the FWKO stage 46 which separate the bitumen and solvent, and the solvent is provided to a VRU module 71. The output of the VRU module 71 is provided to a condenser 72 (e.g., air or glycol water cooled) to condense the light solvents (e.g., propane or butane). The output of the condenser 72 is provided to a separator 70, which separates gas, water, and the solvent as indicated.

In some embodiments, the solvent condenser function may be performed by a flash drum which operates at near to atmospheric pressure. In the flash drum solvent is liberated as a vapor from the bitumen leaving the hot bitumen or "Hotbit" product. The liquids flowing to the flash drum may be heated if required to ensure the solvent content of the Hotbit is reduced to a trace. The Hotbit stream is routed to Hotbit tanks 53, which again may be part of the associated field assets for the well pad. In some embodiments, one or more heaters 54 may be used to keep the bitumen within the tanks at a desired temperature for subsequent transfer to tanker trucks or heated bitumen pipeline to be taken to a rail station. That is, the higher temperature (e.g., in a range of 75 to 100° C., although higher temperatures may also be used) keep the Hotbit in a liquid state so that it will flow more readily into the awaiting tanker trucks. The method illustrated in FIG. 3 concludes at Block 66.

Because the ESEIEH process does not require water to be injected into the well, but instead only extracts produced water as part of the process, the liquid emulsion need not be cooled as in typical SAGD processes for the excess water removal. Instead, the bitumen may be maintained at relatively high temperatures from the time it exits the well throughout the treatment process (e.g., in a range of 75 to 100° C., as noted above). This allows the liquid to flow more readily through the portable initial separation module 31, portable free water removal module 32, and portable condenser module 34 without the need for added diluent, as in typical SAGD processing.

Moreover, since the emulsion from the producer well 43 already includes sufficient solvent (e.g., propane or butane) to create the gravity delta required in the FWKO, this is a further reason that diluent need not be added. The FWKO stage 46 (operating at high pressure to suppress foaming due to flashing) may advantageously remove the fractional volumes of produced connate water from the emulsion. Plus, the subsequent heating and pressure reduction may remove most of the residual water in the vapor phase and recover the solvent for reuse.

Another advantage of the above-noted process is that the hot undiluted bitumen is not required to meet pipeline water content/diluent specifications. That is, the resulting undiluted Hotbit may advantageously be transported safely by railcars, for example, rather than by pipeline. More particularly, when diluent-rich bitumen extracted and treated in a SAGD process is shipped by railcar, there is a risk of explosion in the event of an accident. More particularly, the diluent added to make bitumen flow into and out of the tank cars makes the blended lading quite volatile. That is, diluted bitumen has a much lower flash point than raw bitumen, with an ignition point at −35° C., compared to −9° C. for conventional light oil. On the other hand, undiluted bitumen has a flash point of +166° C.

In accordance with the present approach, steam-coil railcars or other heated tanker cars may be used to transport the undiluted bitumen. Thus, while the bitumen may cool during transport, the railcars may be readily heated to raise the temperature of the bitumen once it arrives at a refinery so that it will return to a liquid state and drain from the railcars.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A portable modular treatment system to be remotely deployed adjacent a solvent extraction bitumen well and comprising:

a portable initial separation module configured to receive a liquid emulsion from the solvent extraction bitumen well comprising bitumen, produced water, solvent, and at least one non-condensable gas, and liberate the at least one non-condensable gas while the solvent remains with the liquid emulsion;

a portable free water removal module configured to receive the liquid emulsion from said portable initial separation module and separate the bitumen and solvent from the produced water;

a portable skimming tank module configured to receive the produced water from said portable free water removal module and remove free oil from the produced water through gravity separation, said portable skimming tank module comprising at least one cooler for cooling the produced water prior to removal of the free oil through gravity separation; and a portable condenser module configured to receive the bitumen and solvent from said portable free water removal module and separate the bitumen and solvent.

2. The portable modular treatment system of claim 1 wherein said portable initial separation module is pressurized to a first pressure, and said portable free water removal module is pressurized to a second pressure less than the first pressure.

3. The portable modular treatment system of claim 2 wherein said portable condenser module is at atmospheric pressure; and wherein the first and second pressures are above atmospheric pressure.

4. The portable modular treatment system of claim 1 wherein said portable condenser module is further configured to receive the at least one non-condensable gas from said portable initial separation module as fuel.

5. The portable modular treatment system of claim 1 wherein said portable skimming tank module comprises at least one weir oil skimmer.

6. The portable modular treatment system of claim 1 wherein said portable condenser module further comprises a vapor recovery unit.

7. The portable modular treatment system of claim 1 wherein said portable initial separation module, portable free water removal module, and portable condenser module are configured to maintain the solvent and bitumen at a temperature of at least 75° C.

8. The portable modular treatment system of claim 1 further comprising at least one bitumen holding tank for receiving the separated bitumen from said portable condenser module, and at least one heater for maintaining the bitumen at a temperature of at least 75° C. while in said at least one bitumen holding tank for transfer to at least one railcar.

9. The portable modular treatment system of claim 1 wherein said portable initial separation module comprises a plurality thereof connected in parallel to the liquid emulsion from the solvent extraction bitumen well.

10. The portable modular treatment system of claim 1 wherein each of said portable initial separation module, said portable free water removal module, said portable skimming tank, and said portable condenser module comprises a respective frame for truck transportation.

11. A portable modular treatment system to be remotely deployed adjacent a solvent extraction bitumen well and comprising:

a portable initial separation module configured to receive a liquid emulsion from the solvent extraction bitumen well comprising bitumen, produced water, solvent, and at least one non-condensable gas, and liberate the at least one non-condensable gas while the solvent remains with the liquid emulsion, said portable initial separation module being pressurized to a first pressure;

a portable free water removal module configured to receive the liquid emulsion from said portable initial separation module and separate the bitumen and solvent from the produced water, said portable free water removal module being pressurized to a second pressure less than the first pressure;

a portable skimming tank module configured to receive the produced water from said portable free water removal module and remove free oil from the produced water through gravity separation, said portable skimming tank module comprising at least one cooler for cooling the produced water prior to removal of the free oil through gravity separation; and a portable condenser module configured to receive the bitumen and solvent from said portable free water removal module and separate the bitumen and solvent, said portable condenser module being further configured to receive the at least one non-condensable gas from said portable initial separation module as fuel.

12. The portable modular treatment system of claim 11 wherein said portable condenser module is at atmospheric pressure; and wherein the first and second pressures are above atmospheric pressure.

13. The portable modular treatment system of claim 11 wherein said portable initial separation module, portable free water removal module, and portable condenser module are configured to maintain the solvent and bitumen at a temperature of at least 75° C.

14. The portable modular treatment system of claim 11 further comprising at least one bitumen holding tank for receiving the separated bitumen from said portable condenser module, and at least one heater for maintaining the bitumen at a temperature of at least 75° C. while in said at least one bitumen holding tank for transfer to at least one railcar.

15. A hydrocarbon resource recovery system comprising:

at least one solvent extraction bitumen well using electromagnetic heating;

a portable modular treatment system to be remotely deployed adjacent the at least one solvent extraction bitumen well using electromagnetic heating and comprising a portable initial separation module configured to receive a liquid emulsion from the solvent extraction bitumen well comprising bitumen, produced water, solvent, and at least one non-condensable gas, and liberate the at least one non-condensable gas while the solvent remains with the liquid emulsion, a portable free water removal module configured to receive the liquid emulsion from said portable initial separation module and separate the bitumen and solvent from the produced water, a portable skimming tank module configured to receive the produced water from said portable free water removal module and remove free oil from the produced water through gravity separation, said portable skimming tank module comprising at least one cooler for cooling the produced water prior to removal of the free oil through gravity separation, and a portable condenser module configured to receive the bitumen and solvent from said portable free water removal module and separate the bitumen and solvent.

16. The hydrocarbon resource recovery system of claim 15 wherein said portable initial separation module is pressurized to a first pressure, and said portable free water removal module is pressurized to a second pressure less than the first pressure.

17. The hydrocarbon resource recovery system of claim 16 wherein said portable condenser module is at atmospheric pressure; and wherein the first and second pressures are above atmospheric pressure.

18. The hydrocarbon resource recovery system of claim 15 wherein said portable condenser module is further configured to receive the at least one non-condensable gas from said portable initial separation module as fuel.

19. The hydrocarbon resource recovery system of claim 15 wherein said portable skimming tank module comprises at least one weir oil skimmer.

20. The hydrocarbon resource recovery system of claim 15 wherein said portable condenser module further comprises a vapor recovery unit.

21. The hydrocarbon resource recovery system of claim 15 wherein said portable initial separation module, portable free water removal module, and portable condenser module are configured to maintain the solvent and bitumen at a temperature of at least 75° C.

22. The hydrocarbon resource recovery system of claim 15 further comprising at least one bitumen holding tank for receiving the separated bitumen from said portable condenser module, and at least one heater for maintaining the bitumen at a temperature of at least 75° C. while in said at least one bitumen holding tank for transfer to at least one railcar.

23. The hydrocarbon resource recovery system of claim 15 wherein said portable initial separation module comprises a plurality thereof connected in parallel to the liquid emulsion from the solvent extraction bitumen well.

24. The hydrocarbon resource recovery system of claim 15 wherein each of said portable initial separation module, said portable free water removal module, said portable skimming tank, and said portable condenser module comprises a respective frame for truck transportation.

* * * * *